US006405919B2

(12) United States Patent
Frohne et al.

(10) Patent No.: US 6,405,919 B2
(45) Date of Patent: Jun. 18, 2002

(54) PROCESS FOR THE CONTINUOUS PRODUCTION OF LONGITUDINALLY SEAM-WELDED AND CORRUGATED METAL TUBES

(75) Inventors: Christian Frohne, Hannover; Ernst Hoffmann, Langenhagen; Wolfram Klebl, Isernhagen; Dieter Muller, Wedemark, all of (DE)

(73) Assignee: Nexans, Paris (FR)

( * ) Notice: Subject to any disclaimer, the term of this patent is extended or adjusted under 35 U.S.C. 154(b) by 17 days.

(21) Appl. No.: 09/759,239

(22) Filed: Jan. 16, 2001

(30) Foreign Application Priority Data

Jan. 28, 2000 (DE) ..... 004 00 265

(51) Int. Cl.[7] ..... B21D 39/03; B23K 31/00; B23K 37/00

(52) U.S. Cl. ..... 228/173.7; 228/173.6; 228/15.1; 228/17.5; 29/33 D

(58) Field of Search ..... 228/129, 164, 228/173.1, 173.4, 173.6, 173.7, 15.1, 17.5; 29/407.01, 33 D

(56) References Cited

U.S. PATENT DOCUMENTS 3,580,024 A * 5/1971 Mattil
3,601,570 A * 8/1971 Davis
3,602,172 A * 8/1971 Bray
3,613,982 A * 10/1971 Hollenberg et al.
3,635,111 A * 1/1972 Zieg et al.
3,662,579 A * 5/1972 Lewis
3,700,158 A * 10/1972 Schatz et al.
3,947,947 A * 4/1976 Hess et al.
4,008,592 A * 2/1977 Hall et al.
4,079,614 A * 3/1978 Hall et al.
4,205,940 A * 6/1980 Golick
4,339,654 A * 7/1982 Harriau et al.
4,406,142 A * 9/1983 Kelstrom et al.
4,413,180 A * 11/1983 Libby
4,501,948 A * 2/1985 Yampolsky et al.
5,282,313 A * 2/1994 Podhorsky et al.
5,325,693 A * 7/1994 Hoffmann et al.
5,421,229 A * 6/1995 Grossmann et al.
5,454,286 A * 10/1995 Takaha
5,815,902 A * 10/1998 Osterried et al.
6,178,884 B1 * 1/2001 Weschenfelder

OTHER PUBLICATIONS

US 2001/0010113 A1 Frohne et al. (Aug. 2, 2001).*
Derwent (1973–26941U).*

* cited by examiner

*Primary Examiner*—Tom Dunn
*Assistant Examiner*—Kiley Stoner
(74) *Attorney, Agent, or Firm*—Sughrue Mion, PLLC

(57) ABSTRACT

In a process for the continuous production of longitudinally seam-welded and corrugated metal tubes (46), a metal band drawn off from a supply reel is formed into an open-seam tube, welded at its longitudinal edges, and the welded smooth tube (45) corrugated. A withdrawal apparatus driven by an electric motor engages the smooth tube. The smooth tube (45) is corrugated by means of a corrugation plate (43) located in a corrugation head (42) which can be driven rotationally. The corrugation head (42) is driven directly by a hollow shaft motor (37, 38).

15 Claims, 4 Drawing Sheets

PROCESS FOR THE CONTINUOUS PRODUCTION OF LONGITUDINALLY SEAM-WELDED AND CORRUGATED METAL TUBES

BACKGROUND OF THE INVENTION

This application is based on and claims the benefit of German Patent Application No. 00400265.5 filed Jan. 28, 2000, which is incorporated by reference herein.

The invention relates to a process for the continuous production of longitudinally seam-welded and corrugated metal tubes, the method comprising the steps of forming a metal band drawn off from a supply reel into an open-seam tube, welding the tube at its longitudinal edges, and corrugating the welded smooth tube by engaging the smooth tube by a withdrawal apparatus driven by an electric motor and corrugating the smooth tube by means of a corrugation plate located in a rotationally driven corrugation head. The invention further relates to an apparatus for the continuous production of such metal tubes, the apparatus including a supply reel for a metal band, a forming apparatus forming the metal band into an open-seam tube, a welding apparatus welding the open seam of the open-seam tube, a withdrawal apparatus driven by an electric motor and engaging the welded metal tube, and a corrugation apparatus which has a rotationally driven corrugation head with a corrugation plate, located in the interior of the corrugation head, which forms the corrugation in the smooth tube.

DE-A-16 52 990 discloses a device for the continuous corrugation of thin-walled, in particular longitudinally seam-welded, smooth tubes in which a metal band drawn off from a supply reel is formed into an open-seam tube, welded at its longitudinal edges, and fed to a corrugation apparatus in which the welded smooth tube is provided with a corrugation in the form of a helix. The corrugation apparatus consists of a housing in which, coaxial to the smooth tube running through, a corrugation head is disposed so that it can be driven rotationally. In the corrugation head a corrugation roller ring is mounted so that it is freely rotatable, eccentric to the smooth tube, and of smaller inclination than the pitch of the helix, said corrugation roller ring rolling on rotation of the corrugation head on the surface of the smooth tube and thereby forming the wall of the smooth tube.

The rotational drive of the corrugation head is coupled via a gear mechanism to a withdrawal apparatus with which the smooth tube is transported. The corrugation head is fastened to the hollow shaft, which carries on its outer surface a toothed wheel which engages with a pinion of a toothed gearing. The toothed gearing is coupled via a continuously regulatable gearing to a main drive motor which simultaneously drives the withdrawal apparatus.

With such an apparatus it is possible in a continuous mode of operation to produce metal tubes corrugated in the form of a helix or annulus.

Due to the large encircling mass of the corrugation head and the hollow shaft, the speed of rotation of the corrugation head and thus the rate of production for the corrugated metal tube is naturally relatively low.

DE-A-20 49 235 discloses another corrugation apparatus, wherein a rotationally driven corrugation head is provided which, as described above, can be driven via a hollow shaft, toothed gearing, continuously regulable gearing, and an electric motor. A corrugation tool is mounted in the corrugation head, the tool having a deformation rib which generates the corrugation. The deformation rib has a curve in the form of a helix and its clear width is smaller than the outer diameter of the smooth tube. During the corrugation process, the deformation rib is, so to speak, screwed onto the smooth tube and forms a corrugation in the form of a helix in the wall of the tube. This corrugation technology is used principally for the production of high-frequency cables. However, the same drive is used, and the apparatus therefore suffers from the same disadvantages described above.

SUMMARY OF THE INVENTION

An object of the present invention is thus to improve the prior-art corrugation processes and corrugation apparatuses, with the aim of reducing the encircling mass and thereby increasing the rotational speed of the corrugation head to thereby permit a higher rate of production to be achieved.

This object is realized by a process for the continuous production of longitudinally seam-welded and corrugated metal tubes, the method comprising the steps of forming a metal band drawn off from a supply reel into an open-seam tube, welding the tube at its longitudinal edges, and corrugating the welded smooth tube by engaging the smooth tube by a withdrawal apparatus driven by an electric motor and corrugating the smooth tube by means of a corrugation plate located in a rotationally driven corrugation head, said method characterized by the fact that the corrugation head is driven directly by a hollow shaft motor.

The object of the invention is further realized by an apparatus for the continuous production of longitudinally seam-welded and corrugated metal tubes, said apparatus comprising a supply reel for a metal band, a forming apparatus forming the metal band into an open-seam tube, a welding apparatus welding the open seam of the open-seam tube, a withdrawal apparatus driven by an electric motor and engaging the welded metal tube, and a corrugation apparatus which has a rotationally driven corrugation head with a corrugation plate, located in the interior of the corrugation head, which forms the corrugation in the smooth tube, wherein said corrugation head is driven by a hollow shaft motor rotor formed as a tube.

The significant advantage of the invention is that by the use of a hollow shaft motor the number of rotating machine elements in the corrugation apparatus can be reduced to a minimum. The moment of inertia of the rotating elements is reduced to the moment of inertia of the hollow shaft or the rotor of the hollow shaft motor. An increase of the control speed of the drive system results which leads to an improvement of the quality of the corrugated tube. In particular, if the corrugated tubes are used for high-frequency transmission, for example, as hollow conductors or as inner and/or outer conductors of a coaxial high-frequency cable, a uniform form of the corrugation leads to a reduction of the height of reflection points as well as to a reduction of the level of reflection.

BRIEF DESCRIPTION OF THE DRAWINGS

The invention will now be explained in more detail with the aid of exemplary embodiments represented schematically in the accompanying figures, wherein.

DETAILED DESCRIPTION OF THE INVENTION

Figure 1:
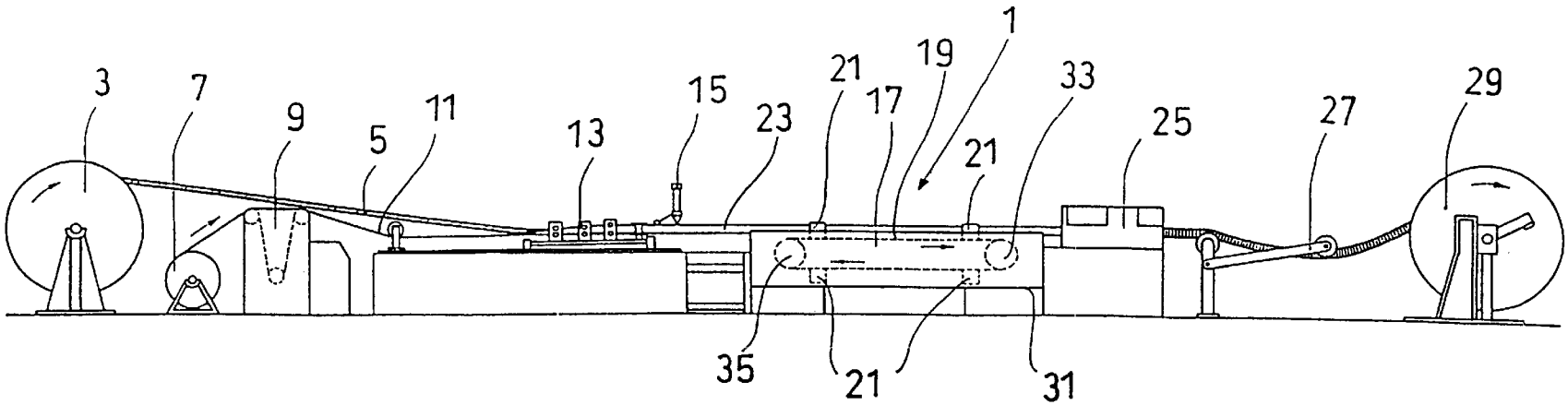
FIG. 1 shows a view of a production line for, e.g., high-frequency coaxial cables.

FIG. 1 shows a view of a production line 1 for, e.g., high-frequency coaxial cables. From a supply drum 3 the inner conductor 5, provided with spacers (not drawn in more detail) is drawn off, said inner conductor being, for example, a corrugated copper tube. From a supply reel 7, a metal band 11, e.g., of copper, is drawn off, transported to a cleaning apparatus 9, and fed to a forming apparatus 13 in which the copper band 11 is formed into a tube with a longitudinal open seam and concentric to the inner conductor 5. By means of a welding apparatus 15, preferably a WIG welding device, the longitudinal open seam is welded. A withdrawal apparatus 17 is disposed, as seen from the direction of passage, behind the welding device 15, the withdrawal apparatus transporting the welded tube 23 and therewith the inner conductor 5 and the copper band 11. The withdrawal apparatus 17 consists of an endless chain 19 on which collet chucks 21 are mounted at intervals. Within the withdrawal housing 31 chain wheels 33 and 35 are provided by which the endless chain 19 is conducted. The chain wheel 33 is driven by means of an electric motor not represented and drives the chain 19 with the collet chucks 21 mounted thereon while on the other hand the chain wheel 35 serves as chain clamping wheel.

A corrugation apparatus 25 is disposed behind the withdrawal apparatus 17, the apparatus 25 forming on the wall of the welded tube 23 an annular or helical corrugation. Regulated via a compensating roller 27, the high-frequency cable thus produced is wound up onto a cable drum 29. In the finished high-frequency cable, the tube 23, after it has been provided with a corrugation, forms the outer conductor.

Figure 2:
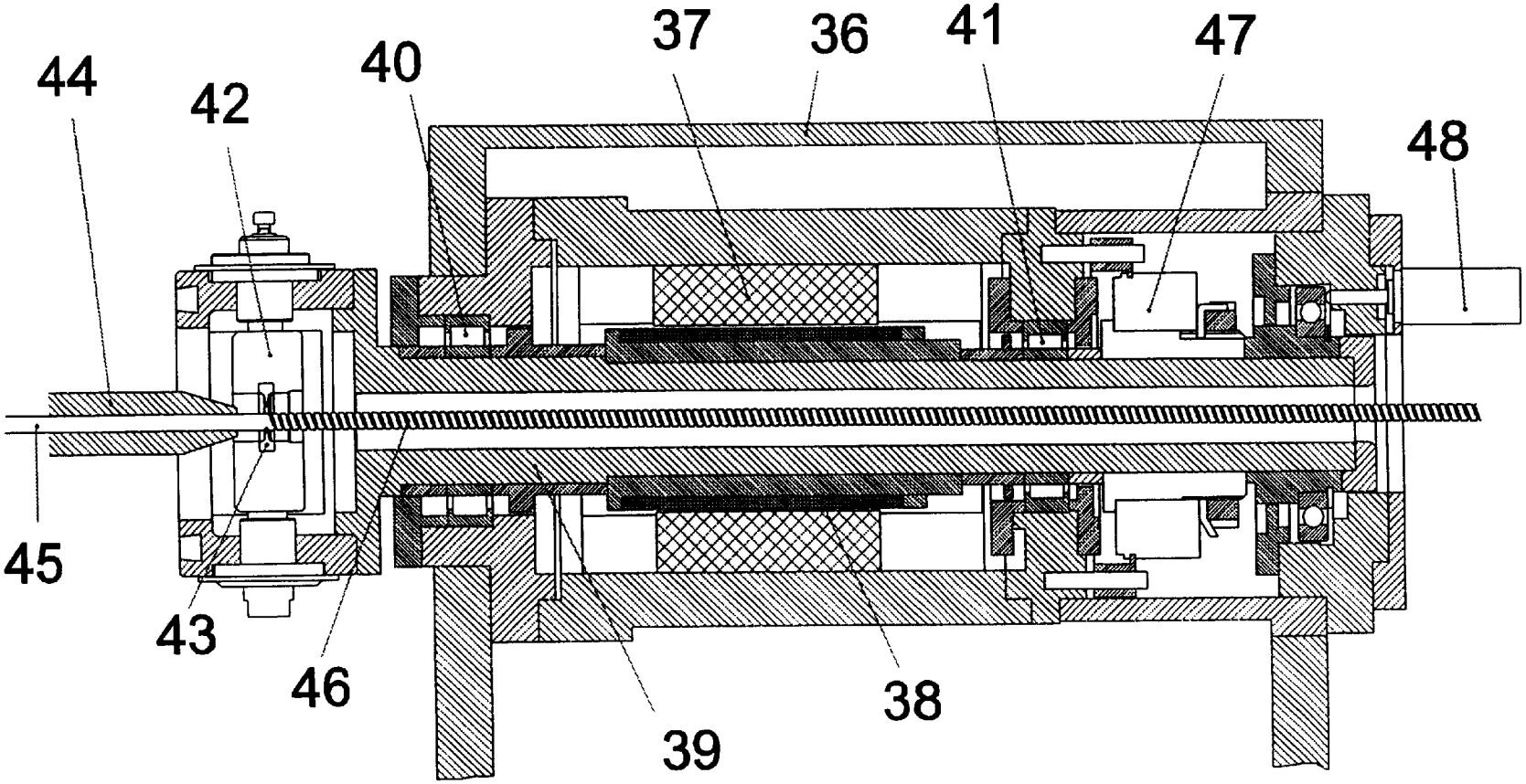
FIG. 2 illustrates a corrugation apparatus.

The withdrawal apparatus 17 is the object of DBP 11 64 355, incorporated by reference herein. In FIG. 2, the corrugation apparatus is represented. In a fixed housing 36, the stator 37 of an electric motor is fixed. The rotor 38 of the electric motor is formed as a hollow shaft (hollow shaft motor). The rotor 38 is fixedly connected to a hollow shaft 39, for example, pressed on or shrunken on. The hollow shaft 39 is rotatably mounted in the fixed housing 36 via roller bearings or bearings 40 and 41 with a longitudinally displaceable inner ring.

At the one end of the hollow shaft 39 the corrugation head 42 is mounted as a flange which is thus driven directly by the hollow shaft motor via the hollow shaft 39. In the corrugation head 42 a corrugation plate 43 is fastened which generates the corrugation in the smooth tube 45. For support of the smooth tube 45, a corrugation bushing 44 is disposed directly in front of the corrugation plate 43, the inner diameter of the corrugation bushing being approximately equal to the outer diameter of the smooth tube 45. The corrugation plate can have an annular, i.e., closed on itself, deformation rib. In this case, the inner diameter of the deformation rib is greater than the outer diameter of the smooth tube 45, and the corrugation plate 43 is disposed freely rotatably and inclined to the longitudinal axis of the smooth tube as well as eccentric to the axis of the tube. The corrugation plate 43 is rolled on the surface of the smooth tube 45 upon rotation of the corrugation head 42 and, due to its eccentric mounting generates a corrugation running helically (see corrugated tube 46).

If a corrugated tube with annular corrugation is supposed to be generated, a corrugated plate 43 with a deformation rib running helically is used.

If a corrugation plate 43 with a helical curve of the deformation rib is used and the clear width of the deformation rib is smaller than the outer diameter of the smooth tube 45, and if the corrugation plate 43 is neither inclined nor eccentric and also not mounted freely rotatably in the corrugation head 42, then the corrugation plate 43 is, so to speak, screwed onto the smooth tube 45 and thereby generates a helical corrugation. The outer diameter of the corrugated tube measured in the trough of the corrugation then corresponds approximately to the clear width of the corrugation plate 43.

The speed of rotation of the hollow motor is coupled at a fixed ratio, but depending on the dimensions of the corrugated metal tube to be produced, to the speed of rotation of the electric motor for the withdrawal apparatus. The speed with which the smooth tube 45 is fed to corrugation head 42 satisfies the equation $$V=n\cdot s\cdot c$$

where n is the speed of rotation of the hollow shaft motor, s the pitch of the corrugation, and c the factor which takes into account the number of roll-overs per ring and the depth of corrugation. By the pitch is understood the distance between two corrugation troughs from one another. The speed of rotation of the hollow shaft motor is measured by means of a resolver or incremental encoder 47.

Now if, for example, limited by a different hardness of the metal band, the speed of rotation of the hollow shaft motor deviates from the predetermined speed of rotation, then the corrugation head 42 works either on pressing or on drawing. In the case of operation on pressing, more smooth tube 45 is supplied than according to the speed of rotation of the hollow shaft motor and the pitch is predetermined, i.e., the smooth tube 45 presses against the corrugating plate 43. In the case of operation on drawing the reverse holds, the corrugation plate 43 tries to draw more smooth tube 45.

This change of the predetermined data is measured by a measuring sensor 48, which can be, e.g., a linear potentiometer, a pressure cell, or a bending element with strain gages known in itself.

The measured value is input into the control circuit, and the speed of rotation of the hollow shaft motor is either increased (on pressing) or reduced (on drawing).

Figure 3:
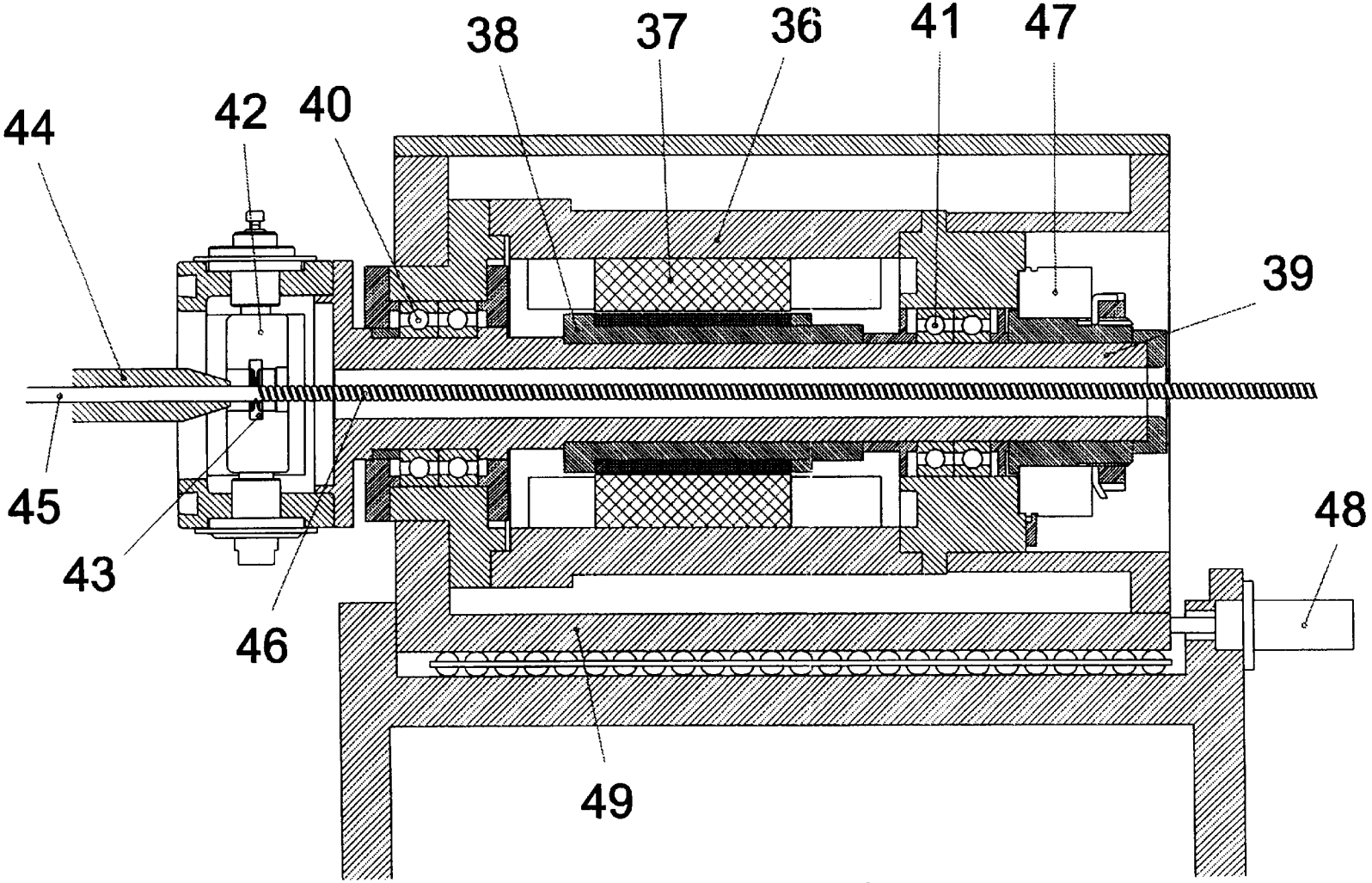
FIG. 3 illustrates an exemplary embodiment of the invention; wherein the hollow-shaft motor is mounted on a longitudinally displaceable carriage whose path of displacement through the linear potentiometer, or whose axial force acting on the pressure cell or bending element, is measured.

In the exemplary embodiment according to FIG. 3 the hollow shaft motor is mounted on a longitudinally displaceable carriage 49 whose path of displacement through the linear potentiometer 48 or whose axial force acting on the pressure cell or bending element is measured.

Figure 4:
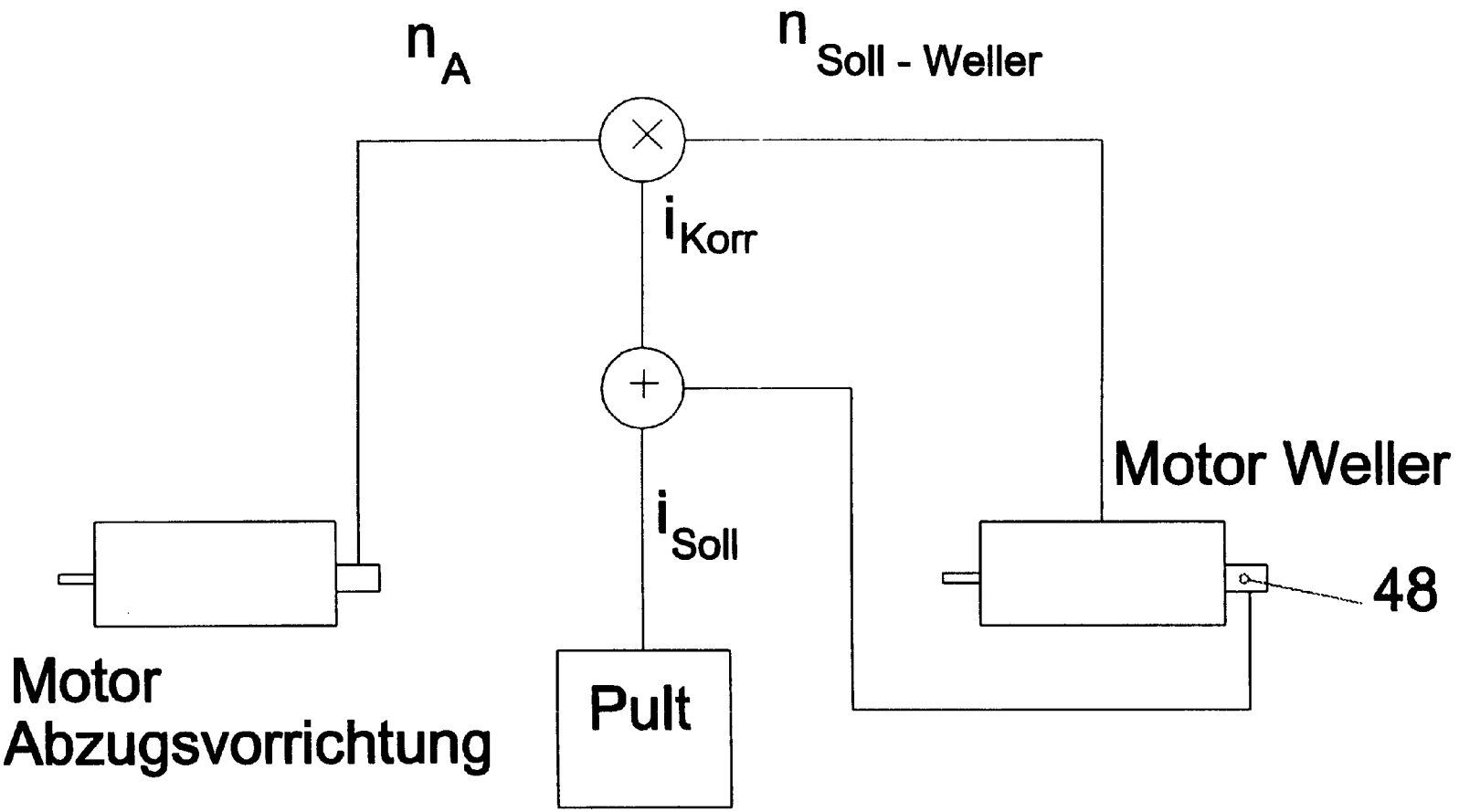
FIG. 4 the control schema for the corrugation process according to the invention.

With the aid of FIG. 4 the control schema for the corrugation process according to the invention are made clear.

The rate of production is preset from the control panel. For the various types of tubes which can be different in diameter, the depth of corrugation, the pitch of corrugation, and the band material an empirically determined relationship $i_{soll}$ [$=i_{theor}$] between the speed of rotation of the withdrawal $n_A$ [$=n_w$] and the speed of rotation $n_{weller}$ [$=n_{corrugator}$] can be determined. With an increase of the rate of production, for example, on startup of the equipment the speed of rotation $n_A$ is increased multiplicatively.

If the corrugation head leaves its axial force-free central position, the value determined by the measuring device 48 is input into the control circuit and a corrected ratio $i_{korr}$ [$=i_{corr}$] is added to the preset value $i_{soll}$ [$=i_{theor}$].

In this way the desired value of the corrugation speed of rotation can be corrected in case of a deviation. This extremely rapid correction is only possible due to the extremely small rotating mass of the hollow shaft motor.

What is claimed is:

1. A process for the continuous production of longitudinally seam-welded and corrugated metal tubes, the method comprising the steps of forming a metal band drawn off from a supply reel into an open-seam tube, welding the tube at its longitudinal edges, and corrugating the welded smooth tube by engaging the smooth tube by a withdrawal apparatus driven by an electric motor and corrugating the smooth tube by means of a corrugation plate located in a rotationally driven corrugation head, said method characterized by the fact that the corrugation head is driven directly by a hollow shaft motor.

2. A process according to claim 1, wherein a speed of rotation of the hollow shaft motor is controlled as a function of a speed of rotation of the electric motor of the withdrawal apparatus.

3. A process according to claim 1, wherein a rotor of the hollow shaft motor is mounted in a stator of the hollow shaft motor so that it can be displaced in the longitudinal direction of the smooth tube, the path of displacement is measured, and the speed of rotation of the hollow shaft motor is corrected as a function of the path of displacement.

4. A process according to claim 3, wherein the path of displacement of the rotor or carriage is measured by means of a linear potentiometer.

5. A process according to claim 3, wherein an axial force acting on a fixed point due to the displacement of the rotor or carriage is measured.

6. A process according to claim 1, wherein the hollow shaft motor is mounted on a carriage that can be displaced in the longitudinal direction of the smooth tube, the path of displacement is measured, and the speed of rotation of the hollow shaft motor is corrected as a function of the path of displacement of the carriage. point due to the displacement of the rotor or carriage is measured.

7. An apparatus for the continuous production of longitudinally seam-welded and corrugated metal tubes, said apparatus comprising a supply reel for a metal band, a forming apparatus forming the metal band into an open-seam tube, a welding apparatus welding the open seam of the open-seam tube, a withdrawal apparatus driven by an electric motor and engaging the welded metal tube, and a corrugation apparatus which has a rotationally driven corrugation head with a corrugation plate, located in the interior of the corrugation head, which forms the corrugation in the smooth tube, wherein said corrugation head is driven by a hollow shaft motor rotor formed as a tube.

8. An apparatus according to claim 7, wherein the corrugation head is mounted as a flange on the rotor.

9. An apparatus according to claim 7, wherein the rotor in the stator is mounted displaceably on the longitudinal axis.

10. An apparatus according to claim 7, wherein the rotor is longer than the stator seen from the direction of the longitudinal axis.

11. An apparatus according to claim 7, wherein the hollow shaft motor is mounted on a carriage that can be displaced in the direction of the longitudinal axis.

12. An apparatus according to claim 7, wherein the speed of rotation of the hollow shaft motor can be recorded by means of a resolver or incremental encoder.

13. An apparatus according to claim 7, wherein the speed of rotation of the hollow shaft motor is limited to a maximum of 6,000 RPM.

14. An apparatus according to claim 7, wherein the path of displacement of the rotor or carriage is measured by means of a linear potentiometer.

15. An apparatus according to claim 7, further a measurement device measuring a force acting on the corrugation plate, a recording device for recording the measured quantity, and a control circuit for the control of the speed of rotation of the electric motor in response to at least said measured quantity.

* * * * *